United States Patent [19]

Carena

[11] 4,156,572

[45] May 29, 1979

[54] INKED RIBBON CARTRIDGE FOR A CALCULATING OR OTHER OFFICE MACHINE

[75] Inventor: Ugo Carena, Ivrea, Italy

[73] Assignee: Ing. C. Olivetti & C., S.p.A., Ivrea, Italy

[21] Appl. No.: 789,222

[22] Filed: Apr. 20, 1977

[30] Foreign Application Priority Data

Apr. 27, 1976 [IT] Italy ..... 68020/76

[51] Int. Cl.[2] ..... B41J 33/10

[52] U.S. Cl. ..... 400/196; 400/197

[58] Field of Search ..... 197/151, 168

[56] References Cited

U.S. PATENT DOCUMENTS

| | | | |
|---|---|---|---|
| 2,103,734 | 12/1937 | Schmidt | 197/168 X |
| 2,508,780 | 5/1950 | Von Duyke | 197/168 |
| 2,755,905 | 7/1956 | Segui | 197/168 |
| 3,349,887 | 10/1967 | Goff | 197/151 |
| 3,356,202 | 12/1967 | Goff | 197/151 |
| 3,621,968 | 11/1971 | Kondur | 197/151 |
| 3,632,052 | 1/1972 | Read | 197/151 UX |
| 3,726,381 | 4/1973 | Murphy | 197/151 X |
| 3,793,951 | 2/1974 | Denley | 197/151 X |
| 3,960,259 | 6/1976 | Guerrini et al. | 197/151 |
| 3,995,731 | 12/1976 | Miller et al. | 197/168 |
| 4,010,839 | 3/1977 | Guerrini et al. | 197/151 |

FOREIGN PATENT DOCUMENTS

| | | | |
|---|---|---|---|
| 2550285 | 5/1976 | Fed. Rep. of Germany | 197/151 |
| 2309341 | 11/1976 | France | 197/151 |

*Primary Examiner*—Ernest T. Wright, Jr.

*Attorney, Agent, or Firm*—Schuyler, Birch, Swindler, McKie & Beckett

[57] ABSTRACT

A cartridge for the inked ribbon of a calculating or other office machine, of the type comprising a platen, a plurality of printing styli disposed in front of the platen at a short distance therefrom, a motive shaft, two fixed stops for transverse positioning of the cartridge with respect to the platen and a longitudinal positioning block. The cartridge comprises a container of substantially parallelepipedal form having a larger side provided with a recess defining two lateral arms. An inked ribbon closed in a loop is disposed inside the container and extends therein between an inking roller and a ribbon tensioning element. The ribbon has a substantially rectilinear portion which emerges from the said lateral arms and spans the recess, parallel to the larger side. The inking roller is housed in a first of the lateral arms, is engageable by the motive shaft of the machine driving the ribbon, and has its diameter substantially equal to a smaller side of the container, while the ribbon tensioning element is housed in the second of the said lateral arms. Two abutment surfaces and a recess co-operate with the said fixed stops and the positioning block, respectively, when the cartridge is mounted on the machine in order to position the ribbon exactly with respect to the platen and the printing styli.

3 Claims, 3 Drawing Figures

INKED RIBBON CARTRIDGE FOR A CALCULATING OR OTHER OFFICE MACHINE

BACKGROUND OF THE INVENTION

The present invention relates to an inked ribbon cartridge for a calculating or other office machine, comprising a container of substantially parallelepipedal form having in a first longer side thereof a recess defining two lateral arms of the container, an inked ribbon closed in a loop disposed inside the container and extending therein between an inking roller and a ribbon tensioning element, the ribbon having a substantially rectilinear portion which emerges from the lateral arms and spans the recess, parallel to the said larger side. Such a cartridge will be referred to as of the type defined.

A cartridge of the type defined is known in which a plurality of rollers mounted rotatably on the container guide the inked ribbon along a predetermined path. One of the rollers, disposed in one corner of the container, effects the transport or drive of the ribbon and the inking roller is mounted rotatably between two of the guide rollers along the path of the ribbon. The ribbon tensioning element is disposed between the driving roller and the inking roller and operates in a loop of the ribbon formed parallel to the larger side of the container. This cartridge has the disadvantage of having the inking roller and the driving roller for the ribbon arranged separated and on opposite sides with respect to the container. Moreover, in order to permit the formation of the loop around the ribbon tensioning element, the dimensions of the cartridge must be rather large and the cartridge itself thus becomes cumbersome.

SUMMARY OF THE INVENTION

These disadvantages are obviated by the cartridge according to the invention, which provides an inked ribbon cartridge of the type defined, wherein the inking roller is housed in a first of the said arms and has its diameter not substantially less than the internal dimension of a smaller side of the container, and wherein the ribbon tensioning element is housed in the second of the said arms, the inking roller acting in operation, as the driving roller for the ribbon.

BRIEF DESCRIPTION OF THE DRAWING

The invention will be described in more detail, by way of example, with reference to the accompanying drawing, in which.

GENERAL DESCRIPTION

Figure 2:
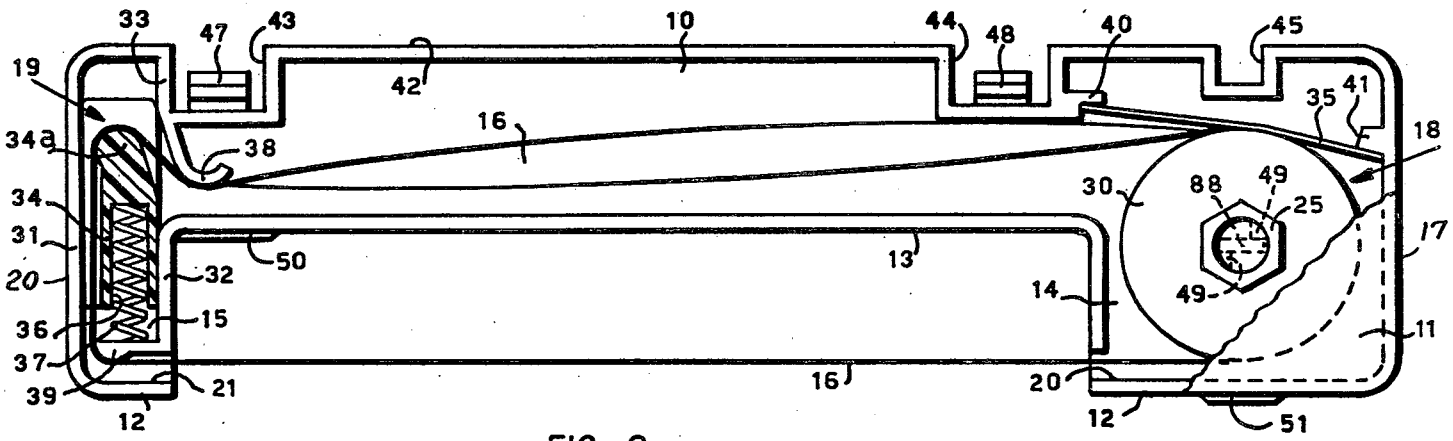
FIG. 2 is a plan view, partly in section, of the cartridge.
Figure 3:
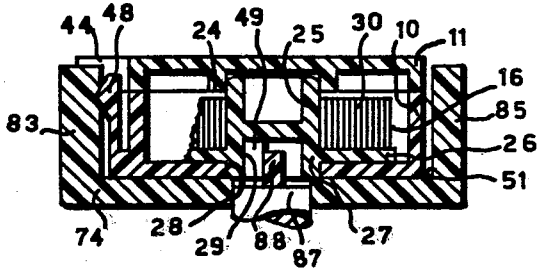
FIG. 3 is a section on the line 3—3 of FIG. 1.

Referring to FIG. 2, the cartridge comprises a container 10 of substantially parallelepipedal form, having, reciprocally opposite, two larger sides 12 and 42 and two smaller sides 17 and 20 and includes a closing cover 11 (FIG. 3). The container 10 proper and the cover 11 are of plastics material and are fixed to one another in any known manner, for example by means of ultrasonic welding.

The dimensions of the cartridge are: length 110 mm, width 26 mm and depth 11 mm. The container 10 is shaped so as to have in a first longer side 12 a recess 13 which extends along a good part of the side 12 so as to define two lateral arms 14 and 15 of the container 10. The lateral arm 14 has a substantially square base dimensioned as the smaller side 17; the lateral arm 15 has a substantially rectangular base, with the longer sides equal to the smaller side 20.

Inside the container 10 there is arranged an inked ribbon 16 closed in the form of a Möbius loop, with a twist between an inking roller 18 arranged in the arm 14 and a ribbon tensioning element 19 housed in the arm 15. The ribbon 16 is about 240 mm long and has a rectilinear portion, substantially parallel to the larger side 12, which emerges from the container 10 through two openings 20 and 21 formed in the arms 14 and 15, respectively, and spans the recess 13.

The inking roller 18 (see also FIG. 3) is connected to a central hub 25 of prismatic shape which has a base disc 26 in its central part and a lower end 27 which is substantially cylindrical and provided with a cavity 29. The hub 25 has its lower end 27 seated in a through hole 28 formed in the base of the container 10 and its upper part seated in a collar 24 formed on the underside of the cover 11. Inside the cavity 29, the hub 25 is provided with two teeth 49 adapted to engage with a motive shaft 87 for feeding the ribbon 16, which shaft 87 is outside the cartridge and will be described later on.

A felt cylinder 30 impregnated with ink and on which the ribbon 16 bears is wedged on the hub 25. A flexible tongue 35 mounted between two ribs 40 and 41 of the container 10 holds the ribbon 16 constantly in contact with the felt cylinder 30.

The ribbon tensioner 19 comprises a block 34 of substantially rectangular shape which is arranged slidably between the side walls 31 and 32 and a bent portion 33 of the container 10. The ribbon tensioner 19 has a rounded portion **34*a* which contacts the ribbon 16 and is provided with a cavity 36 in which a spring 37 is housed; this spring 37 normally biases the block 34 upwardly, keeping the ribbon 16 under tension. In the proximity of the ribbon tensioner 19, the ribbon 16 is guided by two guide elements 38 and 39 formed in the container 10**.

For positioning the cartridge with respect to printing elements or styli 81 of the machine on which the cartridge is used, the container 10 is provided on a larger side 42 thereof opposite the side 12 with two recesses 43 and 44 of substantially rectangular form and with a recess 45 of substantially square form. In each of the recesses 43 and 44 there is arranged a flexible tongue 47, 48, respectively, these tongues 47, 48 being formed integrally on the container 10. Moreover, two abutment surfaces 50 and 51 are formed on the container 10, one inside the recess 13 and the other on the side 12.

Figure 1:
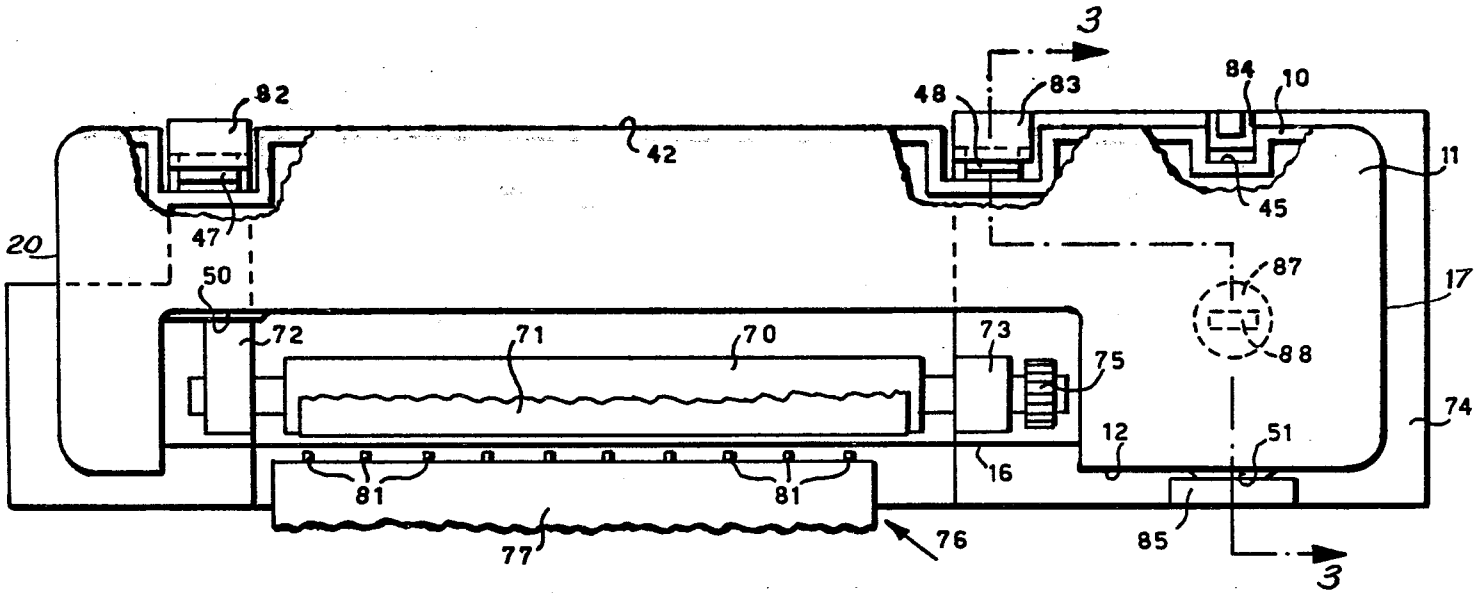
FIG. 1 shows a cartridge embodying the invention mounted in the printing device of a calculating machine.

The cartridge can be employed in calculating machines of known type, for example of the type described in the U.S. patent application Ser. No. 698,923 filed on June 23, 1976, now U.S. Pat. No. 4,077,505, issued on Mar. 7, 1978, the inventors of which are Nicolo Giolitti and Michele Bovio. More particularly, FIG. 1 shows the cartridge mounted in a calculating machine comprising a platen 70 which supports a sheet of paper 71 in a continuous roll. The platen 70 is mounted rotatably between two supporting elements 73 and 72 of a base or bed 74 and is rotated by means of a gear 75 connected to it. In front of the platen 70 there is arranged a stylus printing device 76 which comprises a carriage 77 slidable parallel to the platen 70 and on which there is mounted a plurality of the printing elements or styli 81 which are very close to the platen 70.

The cartridge is mounted on the base 74 so that the platen 70 is housed in the recess 13 of the cartridge and the ribbon 16 is interposed between the printing device 76 and the platen 70.

The cartridge is positioned with respect to the platen 70 by means of a block 84 of the base 74 which is seated in the recess 45. Moreover, two vertical posts 82 and 83 on the base 74 co-operating with the flexible tongues 47 and 48, respectively, keep the abutment surfaces 50 and 51 of the cartridge urged constantly against the supporting element 72 and a fixed stop 85 on the base 74.

For rotation of the inking roller 18 and, therefore, for the feed of the ribbon 16 in front of the printing device 76, a motive shaft 87 is mounted rotatably on the base 74 and is provided with a terminal tongue 88 which engages with the teeth 49 in the hub 25.

In the calculating machine on which the cartridge is mounted, the printing is of the type performed with styli and the distance between the printing device 76 and the platen 70 is a few tenths of a millimeter. It is extremely important that the ribbon 16 be positioned accurately between the platen 70 and the styli 81. In spite of this, it is clear that the cartridge and the inked ribbon 16 can be positioned by the operator without specially seeking alignment with respect to the fixed parts of the machine and in particular with respect to the platen 70. Positioning transverse to the platen 70 is effected by the surfaces 50 and 51 which, by co-operating with the fixed stops 72 and 85 and urged by the vertical posts 82 and 83, maintain the ribbon 16 parallel to the platen 70. Longitudinal positioning is effected by the block 84 which, by operating in the proximity of the motive shaft 87, also ensures the centering of the cartridge with respect to this motive shaft 87.

This positioning system therefore renders the operation of mounting the cartridge in the machine very simple.

What I claim is:

1. An inked ribbon cartridge for a calculating or other office machine having a printing device including a platen, two support elements for rotatably mounting said platen, a plurality of printing styli disposed in front of said platen at a short distance therefrom and a motive shaft, said cartridge comprising:

a container of substantially parallelepipedal form having reciprocally opposite, two larger sides and two smaller sides which define a substantially rectangular base;

a first recess on said container along a first larger side of substantially rectangular section, for lodging said platen and said support elements, said first recess defining a first lateral arm, a second lateral arm and a connecting portion of said container, said first and said second lateral arm each having a slot adjacent to said first recess and to the support elements of said platen;

a feeding inking roller disposed on said first lateral arm and having the sectional diameter substantially equal to the dimension of one of said smaller sides for taking up the whole inner space of the container adjacent to a first of said two support elements;

a guide element adjacent to the slot of said second lateral arm;

an inked ribbon closed in a loop and disposed inside said container between said inking roller and said guide element;

a ribbon tensioning element mounted on said second lateral arm, for causing said inked ribbon to be disposed so as to assume a path of substantially rectangular form, said path having a rectilinear portion, substantially parallel to said larger sides, which emerges from said slots and spans said first recess between said platen and said printing styli for being struck by said printing styli against the platen when the cartridge is mounted, said rectilinear portion having a first end guided by said guide element and a second end guided by said feeding inking roller adjacently to the slot of said first lateral arm; and rotatable means connected to said inking roller for rotatably supporting said inking roller with respect to said container, said rotatable means cooperating, in operation, with said motive shaft for feeding said inking roller and said inked ribbon.

2. A cartridge according to claim 1, wherein said office machine further comprises a fixed stop and a positioning block aligned with said motive shaft, in a plane perpendicular to said platen, and two locking elements aligned with said positioning block in a plane parallel to said platen, and wherein said cartridge further comprises means for exactly positioning the rectilinear portion of said inked ribbon parallel to said platen, between said platen and said printing styli, when said cartridge is mounted on said office machine and said rotatable means cooperates with said motive shaft, said positioning means comprising a first abutment surface of said container, disposed on said first larger side, for cooperating with said fixed stop, a second abutment surface of said container, disposed inside said first recess adjacent said second lateral arm, for cooperating with a second of said two support elements, a second recess formed in a second of said larger sides for cooperating with said positioning block, and two flexible tongues disposed on said second larger side for cooperating with said two locking elements.

3. A cartridge according to claim 1, wherein said first lateral arm is larger than said second lateral arm, and wherein said ribbon tensioning element comprises a block slidably guided on said second lateral arm and which takes up the whole inner space of said second lateral arm, and a compression spring which urges said block away from said guide element.

* * * * *